United States Patent [19]

Hibbard et al.

[11] 4,420,277

[45] Dec. 13, 1983

[54] MINE ROOF DRILLER-BOLTER APPARATUS AND METHOD

[75] Inventors: George A. Hibbard; Ward D. Morrison; Ralph C. Lumbra, all of Claremont, N.H.

[73] Assignee: Joy Manufacturing Company, Pittsburgh, Pa.

[21] Appl. No.: 303,328

[22] Filed: Sep. 18, 1981

[51] Int. Cl.[3] ..... E21D 20/02

[52] U.S. Cl. ..... 405/260; 405/303; 175/85; 175/211; 173/32; 81/57.37

[58] Field of Search ..... 405/259, 260, 261, 303; 175/220, 85, 209, 211; 173/43, 38, 32; 81/57.37; 414/2.5

[56] References Cited

U.S. PATENT DOCUMENTS

| | | | |
|---|---|---|---|
| 895,228 | 8/1908 | Bartlett . | |
| 1,057,568 | 4/1913 | Mayer et al. . | |
| 1,850,317 | 3/1932 | Dikant . | |
| 1,931,348 | 10/1933 | Griffiths . | |
| 2,201,270 | 5/1940 | McIntyre . | |
| 2,590,958 | 4/1952 | Goodrich . | |
| 2,634,952 | 4/1953 | Brinkley . | |
| 2,646,256 | 7/1953 | Lobbert . | |
| 2,781,185 | 2/1957 | Robbins | 175/220 X |
| 2,830,667 | 4/1958 | Walstrom . | |
| 2,870,993 | 1/1959 | Jahnke . | |
| 2,973,820 | 3/1961 | Hagerman et al. . | |
| 3,033,298 | 5/1962 | Johnson . | |
| 3,913,753 | 10/1975 | Swartz | 175/85 X |
| 3,966,053 | 6/1976 | Loftis | 175/85 X |
| 4,158,520 | 6/1979 | Prebensen | 405/260 |
| 4,182,424 | 1/1980 | Prebensen | 175/211 |
| 4,192,631 | 3/1980 | Vass | 405/259 X |
| 4,215,953 | 8/1980 | Perraud | 405/259 X |
| 4,226,559 | 10/1980 | Prebensen | 405/303 |
| 4,229,124 | 10/1980 | Frey | 405/303 |
| 4,258,796 | 3/1981 | Horning | 175/85 X |

FOREIGN PATENT DOCUMENTS

| | | | |
|---|---|---|---|
| 2254715 | 7/1975 | France | 405/261 |

OTHER PUBLICATIONS

Eimco-Secona Roof Bolter Publication copyrighted by Envirotech Corporation in 1973.

*Primary Examiner*—Nile C. Byers, Jr.
*Attorney, Agent, or Firm*—William J. O'Rourke, Jr.; Raymond W. Augustin

[57] ABSTRACT

An apparatus for bolting the roof of an underground mine is disclosed comprising a mobile frame, a boom extending from the frame and a housing provided at the end of the frame. The housing supports an upwardly extending stinger, a drilling mechanism including a drill centralizer having a central bore therethrough and a passageway in communication with the central bore, a device for delivering a container of roof bolting anchoring media through the passageway and through the drill centralizer and into a drilled hole, a device for indexing a roof bolt into alignment with the drilled hole and a spinner for driving the roof bolt into the drilled hole. The present invention also provides a method for bolting the roof of an underground mine comprising the steps of stinging a housing against the roof of the mine, moving a drill centralizer into communication with the roof and drilling a hole in the roof. Without retracting the drill centralizer from communication with the roof, a container of roof bolt anchoring media is delivered through the centralizer and into the drilled hole. The drill centralizer is thereafter retracted and the housing is moved to align a roof bolt with a drilled hole. Then the roof bolt is driven into the drilled hole and the bolt anchoring media sets around the bolt.

41 Claims, 14 Drawing Figures

MINE ROOF DRILLER-BOLTER APPARATUS AND METHOD

BRIEF SUMMARY OF THE INVENTION

The present invention pertains to a new and improved method and apparatus for controlling the roof of an underground mine. More particularly, this invention pertains to a mobile roof bolting machine incorporating a drill and a roof bolt feeding mechanism, and to a method of inserting bolts into a drilled hole in the roof of an underground mine.

Roof control is one of the important aspects of underground mining. The ability to which a roof can be controlled, i.e. supported, determines the size of the working areas at the mining face as well as in the haulways and other passages. As is understandable, as coal is excavated from a working face in an underground coal mine stresses accumulate in the roof. Unless the roof is supported pressures due to such stress may cause the roof to fracture and perhaps collapse in whole or in part.

A common method of supporting a roof is to install a strengthening pin, known as a roof bolt, into the roof of an underground mine. Roof bolting is performed either to anchor a weak immediate roof to a stronger firm roof structure above, or to bind several layers of weak strata into a beam or bridge strong enough to support its own weight across a working place. Roof bolts provide roof control without the drawback of posts and bars which hinder the movement of workers, equipment and material through the mine.

Earlier roof bolts were installed by manually drilling a hole of precise length into the roof of an underground mine. A bolt, consisting of a steel rod, typically three-quarters to one inch in diameter, threaded on one end and slit on the other was placed manually into the hole with the slit end disposed against a wedge. The bolt was manually hammered to drive the wedge into a slot which expanded to anchor the rod in the roof. A square plate was manually slipped over the bottom projecting end of the bolt and was manually tightened with a nut.

More contemporary bolting practices utilize an expanding shell instead of a wedge. Bolting machines have more recently been developed to decrease the time required to drill holes, position bolts and tighten them. See, for example, U.S. Pat. No. 4,226,559. It has further been found that the use of resins can increase the holding ability of expansion anchors. Typically, a resin is held in a plastic tube. A catalyst is brought into communication with the resin when the resin is thrust into a drilled hole in the roof. A bolt is inserted and the resin hardens around the bolt.

With the bolting materials fairly well developed, efforts have been directed toward decreasing the bolting time. Accordingly, a roof bolting method and apparatus is desired which will facilitate hole drilling, bolt feeding, bolt insertion and bolt tightening operations. The improved process of the present invention increases the efficiency with which the bolt is fed into a bolt centralizer device and is delivered into a drilled hole. Such apparatus is characterized by increased flexibility and reach within an underground mine, and permits the operation of the apparatus to be completed from a location rearward of the area being bolted.

The present invention may be summarized as providing an apparatus for bolting the roof of underground mine comprising a mobile frame, a boom extending from the frame and a housing provided at the end of the boom. The housing supports an upwardly extending stinger, a drilling mechanism including a drill centralizer having a central bore therethrough and a passageway in communication with the central bore, a device for delivering a container of roof bolt anchoring media through the passageway and through the drill centralizer and into a drilled hole, a device for feeding a roof bolt into a bolt plate centralizer and indexing the roof bolt into alignment with the drilled hole, and a spinner for driving the roof bolt into the drilled hole. The present invention also provides a method for bolting the roof of an underground mine comprising the steps of stinging a housing against the roof of the mine, moving a drill centralizer into communication with the roof, and drilling a hole in the roof. Without retracting the drill centralizer from communication with the roof, a container of roof bolt anchoring media is delivered through the centralizer and into the drilled hole. The drill centralizer is thereafter retracted and the housing is moved to align a roof bolt, previously fed into a bolt plate centralizer, with a drilled hole. Then the roof bolt is driven into the drilled hole and the bolt anchoring media sets around the bolt.

Among the advantages of the present invention is the provision of a new and improved apparatus for bolting the roof of an underground mine.

The roof bolting apparatus of the present invention has the advantage of increased mobility, flexibility, reach, and remote operability within the operating environment of an underground mine.

An objective of this invention is to provide an apparatus which is characterized by increased efficiency and repeatability in the feeding of a bolt feeding device with a hole that has been drilled in the roof of an underground mine for receiving such bolt.

Another objective of the present invention is the provision of a method and apparatus for providing bolt supports in the roof of an underground mine through the operation of remotely operated drilling and bolting device.

These and other objectives and advantages of the present invention will be more fully understood and appreciated with reference to the following description and the accompanying drawings.

DETAILED DESCRIPTION

Figure 1:
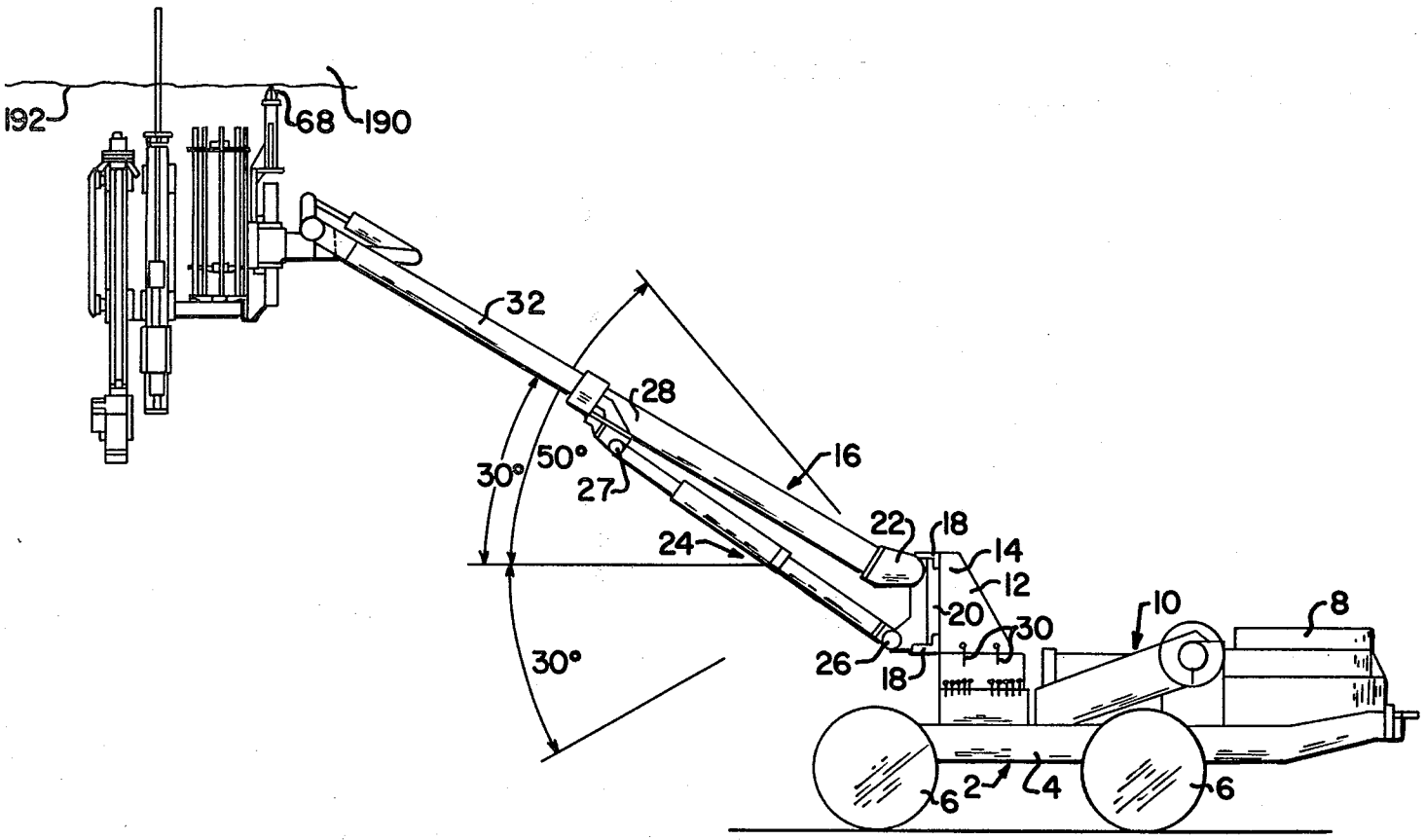
FIG. 1 is a side view showing the general overall arrangement of a roof bolting apparatus of the present invention.

The present invention pertains to an apparatus for drilling and bolting the roof of an underground mine from a remote location. A preferred apparatus is shown in side elevation view in FIG. 1. The view of FIG. 1 is a normal operating position for a roof drilling and bolting machine, and should be referenced for a more complete understanding of the relative terms, upper, lower, inner and outer as used in this application. The following detailed description is directed to the preferred embodiments illustrated in the drawings. Those skilled in the art should understand that various modifications of the attaching mechanisms, structural configurations and the like are within the scope of this invention.

Referring particularly to the drawings, FIG. 1 illustrates an apparatus for drilling and bolting the roof of an underground mine. This apparatus is commonly called a roof bolter. The roof bolter constructed in accordance with the principles of this invention which can be operated in accordance with the method of this invention typically comprises a mobile support or vehicle 2 consisting of a suitable framework 4 supported by suitable wheels 6. It should be undertsood that such framework 4 may alternatively be supported by mobile track device. A suitable prime mover or engine 8 such as a diesel engine is connected by a suitable drive means 10 to selectively drive one or more of the wheels 6 with both the engine 8 and the drive means 10 being suitably supported by the framework 4, preferably on a rearward portion thereof. A boom support 12 is suitably rigidly carried by the framework 4 intermediate the rotative axis of the wheels 6 with an upward and forwardly extending support portion 14 thereof being constructed to support an extensible and the swingable boom assembly 16. Such boom assembly should, therefore, be capable of selective vertical, horizontal and lateral movement. The support portion 14 preferably has a pair of vertically spaced forwardly extending rigid supports 18 which pivotably support a boom connector 20 therebetween.

The support 18 preferably has an upper member (not shown) for pivotably supporting the inner end of the boom assembly 16 for pivotable movement in the vertical direction about pivot point 22. The support 18 also has a lower member (not shown) for pivotably supporting the inner end of an extensible cylinder assembly 24 for pivotable movement in the vertical direction about pivot point 26. The outer end of the cylinder assembly 24 is suitably connected for pivotable movement in the vertical direction about pivot point 27 to the underside of a cylinder portion 28 of the boom assembly 16 so that upon extension and retraction of the cylinder assembly 24 the boom assembly is moved through a vertical arc as shown by the arcuate arrow in FIG. 1. A cylinder assembly (not shown) is also pivotably connected to the boom assembly 16 and pivotably connected to a connector similar to the connector 20 to swing the boom assembly 16 through a horizontal arc. Although both pneumatic and hydraulic cylinder and boom assemblies may be used for the above described structure, hydraulic assemblies are preferred and the further description herein specifically refers to hydraulic assemblies.

Accordingly, the engine 8 or a power take-off or drive means 10 is suitably connected to drive one or more hydraulic pumps (not shown) to permit the actuation and control of the hydraulic assemblies and the vehicle 2. For such purposes appropriate ones of the wheel 6 are provided with suitable hydraulic drive motors (not shown) with the drive motors being suitably connected to actuatable valve assemblies (not shown) selectively connectable to the hydraulic lines from the pump or pumps. Similarly the pump or pumps are selectively connected to various portions of the boom assembly 16 and the cylinder assemblies including assembly 24, via selectively operable valves (not shown). Such valve assemblies are selectively operable by means of various valve actuators 30 suitably carried by the lower portion of the support portion 14.

Inasmuch as the structures heretofore described are generally known in the art, further description thereof is not necessary to one skilled in the relevant art for an understanding of the operation of the vehicle 2 in accordance with this invention. With such generally known structures and by proper operation of the selectively actuatable valve actuators 30, the vehicle 2 and the boom assembly 16 can be selectively positioned, as desired, within a mine passageway in which the roof bolter is used.

Figure 2:
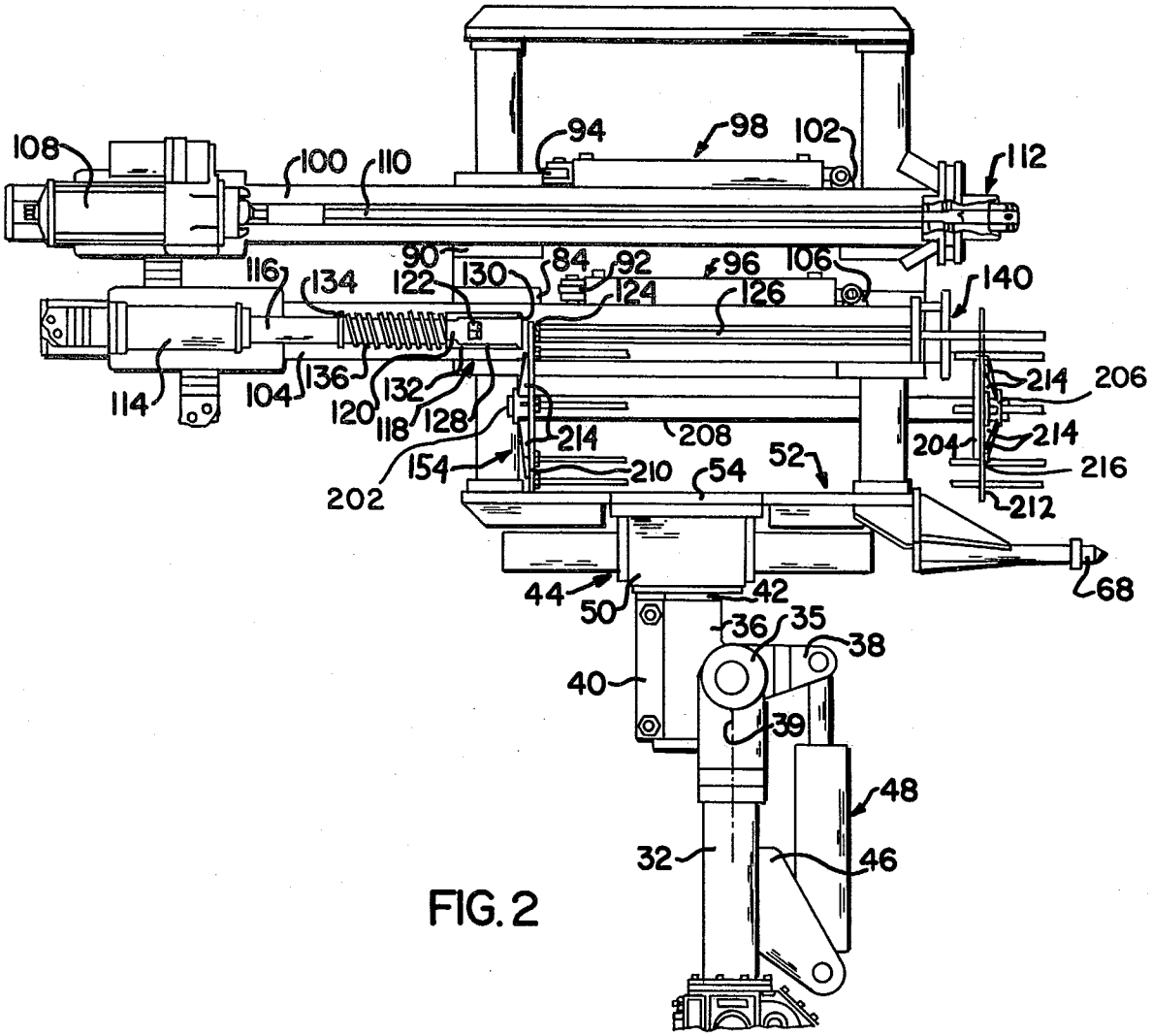
FIG. 2 is an elevation view of a bolter head showing a drill and a bolt inserter provided in the housing at the outer forward end of the boom of the apparatus shown in FIG. 1.
Figure 6:
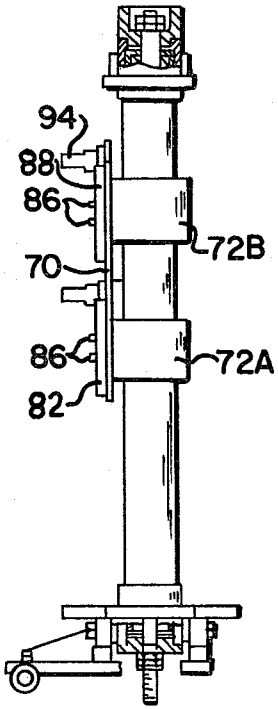
FIG. 6 is a top elevation view of the framework shown in FIG. 4.

The boom assembly 16 has a forward rod member 32, which is selectively extensible and retractable via selective operation of appropriate selectively actuatable actuators 30. As best shown in FIG. 2, the outer forward end of the rod member 32 rigidly supports a transverse pivot shaft 34 which shaft 34 is encompassed by appropriate portions 35 of a connector 36 whereby the connector 36 is pivotable about the central axis of the shaft 34. The connector 36 has a lug portion 38 which extends transversely and upwardly with respect to the central axis 39 of the rod member 32. The connector 36 has a portion 40 located below the central axis 39 for rigidly receiving a shaft 42 which shaft 42 is the input shaft to a roll joint 44. The roll joint 44 is preferably capable of rotating through about 180 degrees of travel. The outer portion of the rod member 32 has a lug 46 rigidly secured thereto which extends vertically outwardly in essentially horizontal alignment with the lug portion 38. A hydraulic extensible cylinder assembly 48 has suitably pivotably secured to the lug 46 and the lug portion 38 so that upon extension and retraction of the assembly 48 the connector 36 pivots with respect to the central axis 39 and for a preferred purpose of this invention the connector 36 pivots through about 69 degrees of travel about the central axis of the shaft 34.

Figure 4:
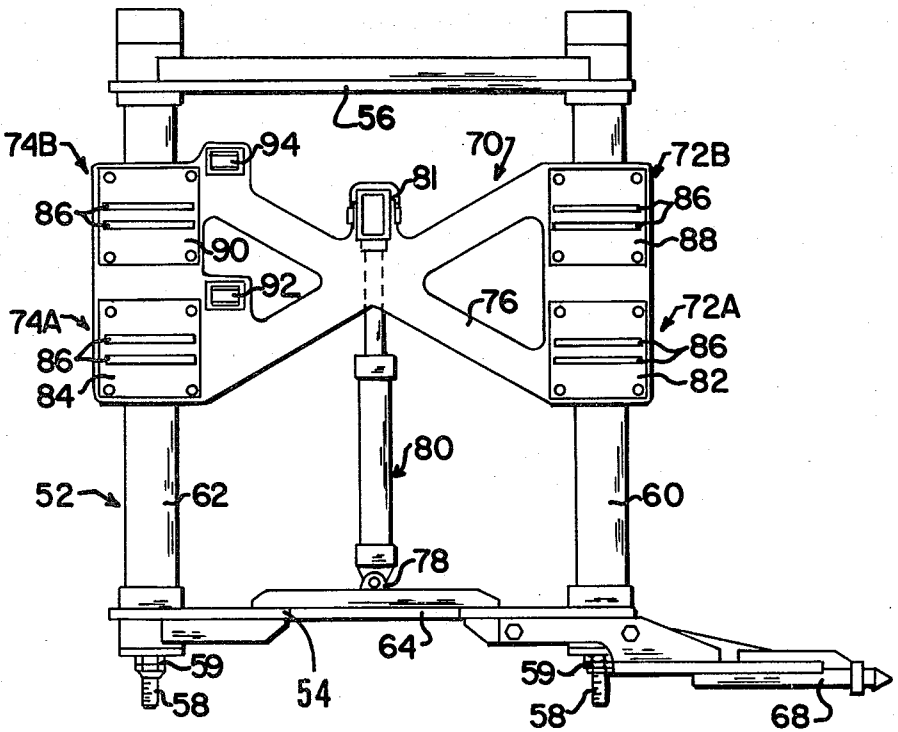
FIG. 4 is a side elevation view of the framework and slide assembly for the bolter head of the present invention.

About the roll joint 44 is a housing 50 which extends transversely of the central axis of the shaft 42 and is rotatable about the central axis of the shaft 42. The shaft 42 extends into the housing 50 and is cooperable with the internal structure of the roll joint 44 whereby the housing 50 can rotate through about 180 degrees of travel with respect to the central axis of shaft 42. The side of the housing 50 is rigidly secured to a rigid framework 52 which rotates therewith as does all the hereinafter described structure carried by framework 52 on the housing 50. The structure carried by the framework 52 on the housing 50 is collectively called the bolter head. The framework 52, as best shown in FIG. 4 when viewed in side elevation is a fabricated, generally rectangular structure having an inner and an outer cross member 54 and 56, respectively, which are bolted together in spaced relationship by end threaded tie rods 58 and nuts 59 extending through upper and lower slide members 60 and 62, respectively. Framework 52 is an assembly of members which are bolted together for simplicity of construction; however, framework 52 can be fabricated in any suitable manner such as by weldment or partial weldment depending upon what assembly procedure is employed for the entire structure.

Figure 5:
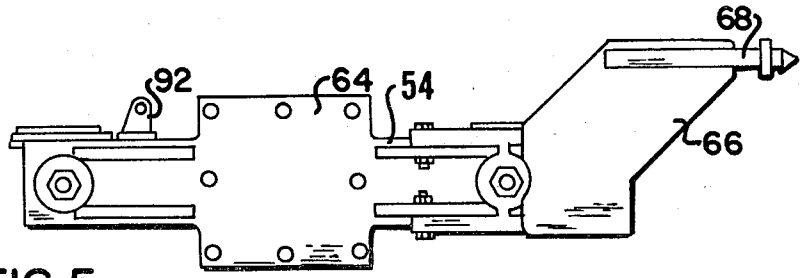
FIG. 5 is a front elevation view of the framework shown in FIG. 4.

The inner cross member 54 of the framework 52 as shown in FIGS. 4 and 5, has an enlarged central portion 64 with a suitable bolt hole pattern to permit the housing 50 of the roll joint 44 to be rigidly bolted or otherwise attached thereto. The inner cross member 54 has at its upper end an integral extension 66 for suitably supporting a suitable upwardly extending stinger 68 for stinging the framework 52 as hereinafter described. For the purpose of this application the term stinger is meant to include any device for laterally anchoring the bolter head or housing to the roof of an underground mine to be bolted.

The upper and lower slide members 60 and 62, respectively, are of a suitable cross section, preferably circular, between cross members 54 and 56 to slidably support vertically spaced upper and lower guide sections 72 (*a* and *b*) and 74 (*a* and *b*), respectively, of a slidable table 70. Such guide sections consist of inner guide sections 72*a* and 74*a* and outer guide sections 72*b* and 74*b* spaced outwardly from the inner guide sections 72*a* and 72*b* respectively. The guide sections may be suitably rigidly connected to a formed plate section 76 to form a slidable table 70. Plate section 76 is of any suitable configuration, which is shown in an X configuration, for slidably supporting a drill structure and a spinner structure as hereinafter described. In the illustrated embodiment, a lug 78 extends outwardly of central portion 64 and a lug 81 extends downwardly from the outer central crossed portion of the plate which lug 78 and 81 have suitable aligned openings to pivotably support the opposite ends of an extensible hydraulic cylinder assembly 80 so that upon extension thereof the table 70 slides outwardly over the slide members 60, 62 and upon retraction thereof the table 70 slides inwardly over the slide members 60, 62. Selective actuation of the cylinder assembly 80 is obtained by properly connecting the assembly 80 to a source of pressurized hydraulic fluid selectively controlled by a suitable one of the actuators 30.

The plate section 76 has, at the inner ends of the X configuration a pair of upper and lower, vertically spaced plates 82 and 84, respectively, suitably rigidly secured thereto. Each of the plates 82, 84 has a pair of formed elongated vertically laterally spaced guideways 86 suitably rigidly secured thereto, respectively, which extend outwardly from the plate section 76 from the slide members 62, 64 with the upper and lower guideways 86 being vertically aligned. In a similar manner upper and lower vertically spaced plates 88, 90 are suitably rigidly secured to the outer ends of the X configuration with the guideways 86 similarly secured thereto in vertical alignment. The plate section 76 of the table 70 also includes an integral portion for suitably rigidly supporting a lug 92 upwardly adjacent the outer end of the plate 84 and an integral portion for suitably rigidly supporting a lug 94 upwardly adjacent the outer end of the plate 90. Both lugs 92, 94 extend outwardly of the plate section 76 away from the slide members 62, 64 and have suitable aligned bores therein for suitably pivotably receiving the ends of suitable selectively extendable hydraulic cylinder assemblies 96, 98 therein, respectively, as shown in FIG. 2.

An elongated traveling drill mounting plate 100 overlies the outer guideways 86 on the outer plates 88, 90 and is provided with suitable means (not shown) which interfit and cooperate with the formed guideways 86 on plates 88, 90 to permit the plate 100 to move in either vertical direction while being captively retained with respect to plates 88, 90. A lug 102 extends outwardly from the plate 100 and is provided with a suitable bore for suitably pivotably receiving the other end of the cylinder assembly 98. With such structure, upon selective actuation of the cylinder assembly 98, the plate 100 and the structures carried thereby can be moved upwardly and downwardly over the table 70.

A similar elongated traveling plate 104 is supported similarly as the plate 100 by guideways 86 on the plates 82, 84 with the plate 104 having a lug 106 for suitably pivotably receiving the other end of the cylinder assembly 96. Consequently by suitable selective actuation of the cylinder assembly 96, the plate 104 and the structure carried thereby can be moved upwardly and downwardly with respect to the table 70.

The side of the traveling plate 100 opposite the guideways 86 suitably slidably supports a hydraulic drill motor 108, as best shown in FIG. 2, having an upwardly extending anvil shaft coupled to a drill rod 110 which extends upwardly with its uppermost end being received within a centralizer 112. Drill motors, such as drill motor 108, as well as the drives therefor and the actuation thereof are well known in the art and therefore, any suitable motor, drive and actuation may be used such as a JH4 hydraulic rotary percussion drill in Joy Manufacturing Company. Accordingly, for clarity, the hydraulic lines for selectively providing hydraulic fluid to the drill motor 108, since a hydraulic motor is preferred for motor 108, and the drive between plate 100 and motor 108 have not been shown as such illustration is not necessary for one skilled in the relevant art. The drill motor 108, upon selective actuation by an actuator 30, moves vertically upwardly and downwardly within its limits of travel longitudinally with respect to plate 100 as selected and controlled by an operator. Note that the operator may be safely positioned at a location remote from the area where a bolt is to be provided into the roof of the mine.

As also shown in FIG. 2 the traveling plate 104 slidably supports a suitable bolt spinner or hydraulic motor 114 in the same manner as the plate 100 supports motor 108. A selectively actuatable drive motor and drive device, such as a drive chain structure selectively moves the spinner motor 114 upwardly and downwardly on the plate 104 as hereinafter described.

The spinner motor 114 has an upwardly extending selectively rotatable output shaft 116 which carries a bolt driving assembly 118 at the outer end thereof. The assembly 118 comprises a bolt head drive block 120 which is suitably rigidly secured to the outer end of shaft 116 and extends coaxially upwardly therefrom. The block 120 has a downwardly extending bolt head receiving opening 122 therein which is of a configuration to receive the head 124 of a roof bolt 126 in a manner that upon rotation of the block 120 the roof bolt 126, having its head 124 received in opening 122, is rotated as hereinafter described. Block 120 is coaxially encompassed by formed tubular guide 128 which has a suitable tapered portion 130 at its outer end. The tapered configuration assists in the seating of a bolt head into a tubular guide 128. The lower ends of the guide 128 and the block 120 have suitable cooperable slidable structure, such as splineways 132 whereby the guide 128 is movable downwardly along the block 120. The shaft 116 has a retaining device such as a collar 134 suitably rigidly secured thereto downwardly of the lower end of the guide 128 to support one end of a suitable elongated spring 136. The upper end of the spring 136 abuttingly engages the lower end of guide 128 to bias the guide 128 upwardly with the upward travel of the guide 128 being limited by the engagement of the upper end of the splineways 132. Splineways 132 are downwardly open to permit the guide 128 to retract downwardly with respect to the block 120. In the normal roof bolt receiving position as shown in FIG. 2 the block 120 is received in the lower half of the guide 128. The spring 136 is of a suitable construction to permit the movement of the guide 128 as hereinafter described.

Figure 3:
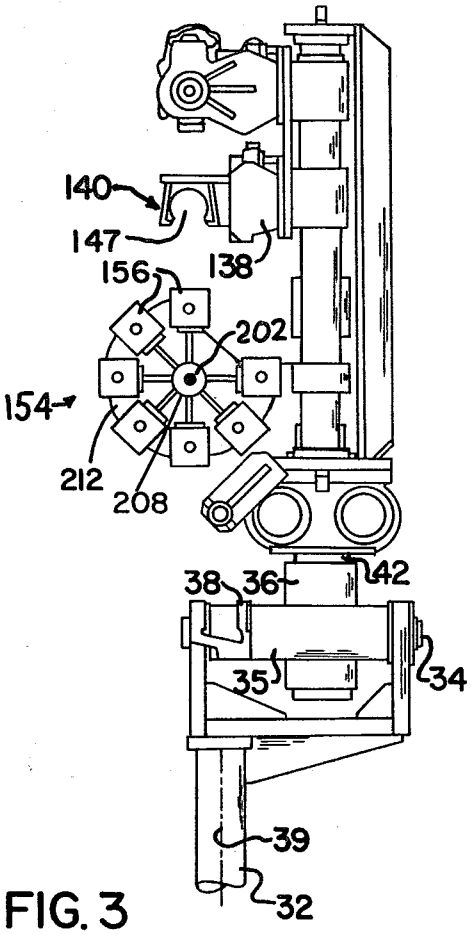
FIG. 3 is a partial plan view of the bolter head shown in FIG. 2 showing an automatic bolt rack and bolt centralizer provided at the outer forward end of the boom on the apparatus shown in FIG. 1.
Figure 7:
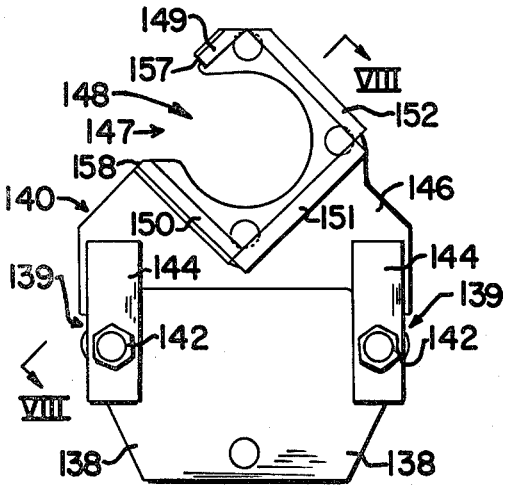
FIG. 7 is a top view of the bolt plate centralizer used in the apparatus of the present invention.
Figure 8:
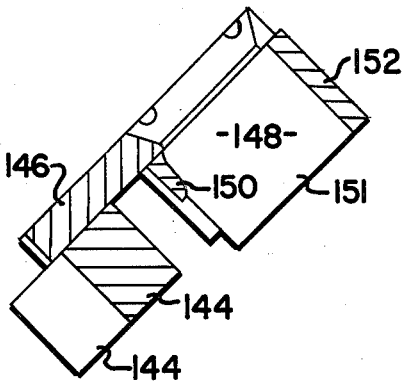
FIG. 8 is a cross-sectional view of the bolt plate centralizer through lines VIII—VIII of FIG. 7.

A formed transverse plate 138, as best shown in FIG. 7, is suitably rigidly secured at the upper end of the traveling plate 104, such as by being welded, which plate 138 extends transversely outwardly to provide outer portions 139 to which a formed bolt plate centralizer assembly 140 is suitably rigidly secured such as by bolts 142. The bolt plate centralizer assembly 140 preferably comprises a pair of horizontally spaced, inwardly extending mounting lugs 144 which are rigidly secured to the plate 138 by appropriate bolts 142 and a lower formed base plate 146 which extends outwardly of the lugs 144. The outermost portion of the plate 146 has a formed opening 147 therein which is smaller than the bolt plate 156 and is substantially surrounded by a plurality of upwardly extending wall segments 149, 150, 151 and 152. Opening 147 is preferably a generally circular opening and open side within plate 146 to permit a portion of a transversely disposed roof bolt 126 with a bolt plate 156 loosely carried at one end of the bolt to enter the opening 148 in one preferred form, as illustrated in FIG. 3, the open side of the opening 147 faces generally inwardly towards the vehicle 2. In another preferred form for operation with a magazine 154, as hereinafter described and as shown in FIG. 7, the open side of the opening 147 is angularly disposed to partially face both toward the vehicle 2 and outwardly of the vehicle 2. Regardless of which direction the opening 147 faces, the structure of the preferred form of the bolt plate centralizer assembly 140 is otherwise identical. The wall segments 149 to 152 form a chamber 148 therebetween for captively receiving a normally rectangular bolt plate 156 loosely carried at the end of the bolt 126 opposite the bolt head. Although the preferred configuration of the chamber 148 is rectangular, the chamber may be of any configuration. It should be understood that the wall segments 149 to 152 are typically arranged to conform to any suitable configuration of a bolt plate 156. To the extent that a bolt plate 156 may be circular or round the chamber may be formed between circular wall segments. As a practical matter, however, only one type of bolt plate configuration is employed in a specific roof bolting operation in an underground mine. However, the bolt plate centralizer assembly 140 may be easily removed from the apparatus of the present invention to permit and facilitate the securing of a different assembly 140 capable of receiving a different configuration bolt plate other than the normally utilized plate 156.

The wall segments 151, 152 which are located outwardly of the opening 148 and away from the direction in which the bolt 126 is to be loaded, extend upwardly above the general plane of the base plate 146. Preferably, the height of these two wall segments 151, 152 are equal, and the height of these two wall segments 151 and 152 is greater than the extent to which wall segments 149, 150 extend above the base plate 146. The lower wall segments 149, 150 are located from the center of opening 148 and facing the direction in which the bolt is to be loaded, and extend upwardly from the base plate 146 a smaller distance than segments 151, 152 extend upwardly therefrom. This structure permits a bolt plate 156, which is moved laterally toward the opening in the centralizer assembly, to pass over segments 149, 150 at a height below the height of the higher wall segments 151, 152. The wall segment 149 is the wall segment which, as best shown in FIG. 7, extends inwardly from the wall segment 152, preferably at a right angle with the innermost end thereof 157 terminating at the edge of the opening 147. Wall segment 150 extends preferably at a right angle to wall segment 151 with its free end 158 also terminating at the edge of the opening 147.

Figure 10:
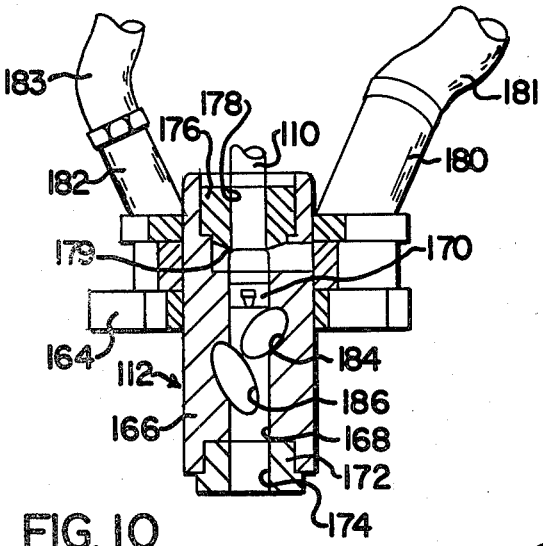
FIG. 10 is a cross sectional view of a drill centralizer assembly.
Figure 9:
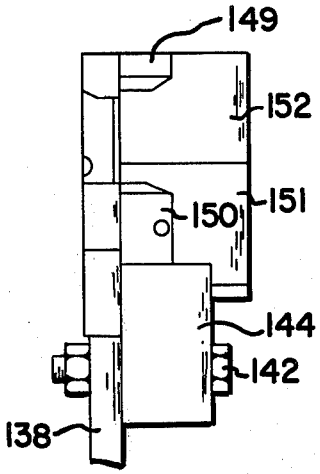
FIG. 9 is a side view of the bolt plate centralizer shown in FIG. 7.
Figure 11:
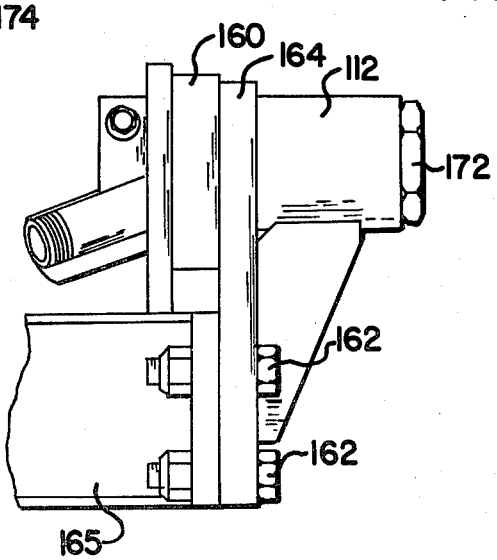
FIG. 11 is a side view of the drill centralizer assembly shown in FIG. 10.

The apparatus of the present invention includes a drill centralizer 112 in addition to a bolt plate centralizer 140. As best shown in FIGS. 10 and 11, a transverse plate 160 is suitably rigidly secured at the upper end of the traveling plate 100, such as by welds, to permit the drill centralizer assembly 112 to be suitably rigidly and removably secured thereto such as by nut and bolt assemblies 162 extending therethrough and through a base plate 164 of the drill centralizer assembly 112. The base plate 164 abuts the plate 160 and extends transversely of the channels 165 to locate the drill rod 110 receiving portion offset from the channels 165 so that the drill rod 110 is free to travel upwardly and downwardly with respect to the channels 165. The assembly 112 has a central upwardly extending body portion 166 with a formed vertical bore 168 extending therethrough for permitting a drill bit 170, suitably attached to the upper end of rod 110 to rotate therewith, in order to vertically traverse the upper portion of the bore 168. The upper end of the body portion 166 is counter bored and suitably rigidly receives a rigid or resilient insert 172 having a central bore 174 in coaxial alignment with the bore 168 to permit the bit 170 to pass therethrough in either vertical direction. The lower end of body portion 166 is counter bored and suitably rigidly receives a rigid or resilient insert 176 having a central bore 178 in coaxial alignment with the bore 168 to permit the drill rod 110 to pass therethrough in either vertical direction. The bore 178 is of smaller cross section than the bore 174 whereby the lower end of the bit 170 abuts the upper surface of the insert 176 upon downward movement of the rod 110 and the attached bit 170. The bit 170 extends transversely outwardly of the drill rod 110 to form a transversely outwardly extending shoulder 179 therebetween. With the bit 170 in the retracted position such lower transverse shoulder 179 of the bit 170 may engage the upper end of the insert 176 to retain the bit 170 within the body portion 166 upon retraction of the rod 110 and the bit 170. The body portion 166 has two conduits or lines 180, 182 suitably rigidly secured thereto which extend downwardly from the body portion 166 at any suitable angle to permit suitable lines such as flexible tubes 181 and 183, to be suitably secured thereto. The upper end of the line 180 communicates with the lower end of a bore 184 extending through the body 166 at a suitable angle so that the upper open end thereof is in communication with the bore 168. In a similar manner line 182 is in open communication with the bore 168 through an angularly extending bore 186. The angular extending bores 184 and 186 are shown in phantom lines in FIG. 10.

With the structure heretofore described a substantially improved roof drilling and bolting operation may be performed as compared to prior roof drilling and bolting procedures. Specifically, the vehicle 2 is positioned in a well known manner to a desired location within a mine to perform a roof drilling and bolting sequence. During such movement of the vehicle 2 the boom assembly 16 is positioned, via the connector 20, the assembly 24, and the swing cylinder assembly, such that the bolter head carried by the table 70 is located so that the table 70 and all structures attached thereto do not interfere with the movement of the vehicle 2. When the vehicle 2 is suitably positioned for subsequent operation, the boom 16 is suitably positioned to permit the proper locating of the table 70 as hereinafter described. Inasmuch as the movement of the vehicle 2 and the boom 16 is well known in the art further description of such positioning is not necessary for an understanding of this invention by one skilled in the relevant art.

With the vehicle 2 and the boom 16 generally positioned as shown in FIG. 1, the roll joint 44 is suitably actuated to suitably position the table 70, and the structure attached thereto, for subsequent operation. At the time of such positioning the traveling plate 100, via actuation of the cylinder assembly 98, is in its retracted or lower position. In the same manner the traveling plate 100, and the structure attached thereto, is, via the cylinder assembly 96, in its retracted or lower position. Simultaneously the cylinder assembly 80 is retracted into its inner position while cylinder assembly 48 is actuated to locate table 70 in at least the approximate desired position. With assemblies 80, 96 and 98 being retracted the roll joint 44 is actuated to position the table 70 in the desired vertical orientation with reference to the roof surface thereabove to be drilled. It is well known that the roof line in underground mines is irregular and accordingly, it may be necessary or desirable to adjust the position of the table 70 by actuating, as desired, the lift cylinder assembly 24, the swing cylinder assembly for the boom assembly 16, the boom assembly 16 itself, the roll joint 44, and/or the tilt assembly 48. Normally all the various actuatable structures need not be actuated to position the table 70; however, the various locations that the table 70 can be positioned by operating actuators adjacent the vehicle can permit the table 70 to be disposed in essentially any position needed for a roof bolting operation from a remote location.

Figure 12:
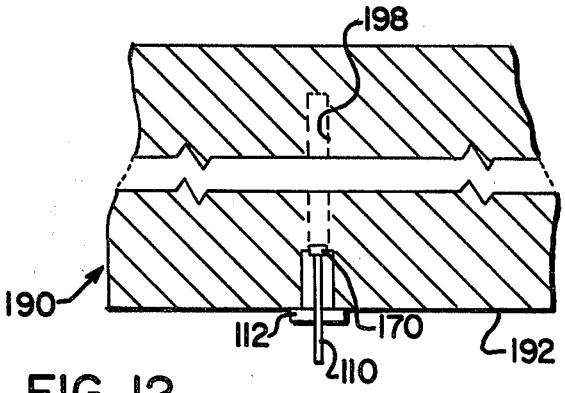
FIGS. 12, 13 and 14 show sequentially the stages of the roof bolting operation with a cross-sectional view through coal strata comprising a coal mine roof.

With the table 70 positioned as desired, the boom assembly 16 is moved upwardly, via actuation of the lift cylinder assembly 24, to move the framework 52 upwardly a relatively small distance, typically on the order of 3 to 4 inches, to force the upper end of the stinger 68 into firm engagement with the roof 190 of the mine passageway. Such engagement of the roof is known as "stinging" a preliminary operation which anchors the framework 52 with reference to the roof. The stinging force is typically on the order of about 2,000 to 4,000 pounds per square inch, and accordingly, the subsequent drilling and bolt insertion force should be less than about one-half of the stinging force. The stinger 68 is of any suitable known structure which can be replaced as desired. The upper end of stinger 68 extends above the upper slide member 60 of the framework 52 a sufficient distance, such as 10 to 12 inches, to locate the side member 60 as close as is feasible with reference to an irregular roof line 192. With the framework 52 stung, i.e., held against the roof under pressure, the drill extension cylinder assembly 98 is actuated to move the traveling framework 100 upwardly until the outside surface of the insert 172 of the drill centralizer assembly 112 is biased by the extension force of the assembly 98 into engagement with the roof 190 at the roof line 192. It will be appreciated that the contact between the drill bit and the roof acts as a secondary stinger. Such secondary stinger is found to be most beneficial in preventing undesirable wiggle of the driller head attached to the table 70 during the drilling and bolting operation. During such movement of the framework 100 the drill motor 108 is not actuated to rotate the drill rod 110 or to move upwardly on the framework 100. Since the force biasing the the centralizer assembly 112 upwardly is counter to the force of the cylinder assembly 24 stinging the framework 52, the cylinder assembly 98 is selected such that the force of the insert 172 on the roof is substantially less, on the order of one-half or less, than the force exerted by the cylinder assembly 24 for stinging the framework 52. With the centralizer assembly 112 so located the drill drive device such as a drive motor (not shown) is suitably actuated to move the drill motor 108, which may be of the rotary type or the rotary percussion type, and the drill rod 110 and the bit 170 attached thereto, upwardly on the framework 100 until the bit 170 engages the roof 190 to be drilled. While the bit 170 is moving upwardly in the drill centralizer assembly 112 the drill motor 108 is actuated to drive the rod 110 and the bit 170. Continued simultaneous actuation of the appropriate motors cause the bit 170 to rotate and simultaneously move upwardly to drill the desired roof bolt hole 198 such as that shown in phantom lines in FIG. 12 as the drill motor 108 moves upwardly on the framework 100. During such drilling operation the broken pieces of the strata being drilled fall downwardly about the bit 170 and continue to fall downwardly through the bores 174 and 168, respectively, into the bore 184 and pass therethrough to a hose connector 180. Such drilled strata passes sequentially through the connector 180 and the hose 181 to suitable collecting means (not shown) or to a desired discharge location. To ensure such flow through the hose 181 a suitable suction blower (not shown) may be connected to the hose 181 as desired.

The length of the hole drilled into the mine roof is dependent upon the length of the framework 100 over which the drill motor 108 travels and for typical roof bolting purposes a length of hole several inches longer than the bolt length, typically four feet, is drilled. Consequently the framework 100 is of a length greater than the bolt length to permit motor 108 to travel slightly further than the bolt length in the drilling mode or operation.

Figure 13:
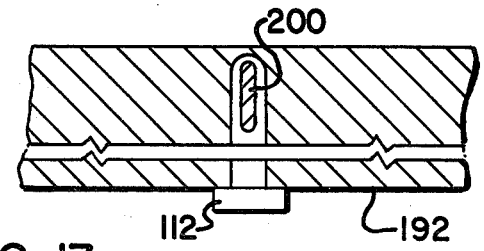

Upon completion of the drilling operation, the actuation of the drill feed device is reversed to move the drill 108 downwardly on framework 100 until the lower shoulder 179 of the drill bit 170 rests upon or near the upper end of the insert 176. As the bit 170 is withdrawn the drilled broken strata from the hole continues to flow through the bore 184 to the discharge line 181. In the lowermost position of the bit 170 the upper end of the bore 184 is located upwardly from the bit 170 so that material from the hole can flow therethrough. With the bit 170 retracted the drill centralizer assembly 112 is retained by actuated assembly 98 in engagement with the roof line 192 and a plastic roof bolting container 200 is then inserted into the upper end of the drilled hole 198 for anchoring a roof bolt as shown in FIG. 13.

The container 200 can be of various well known structures for containing various well known materials for anchoring a roof bolt. Basically a container 200, typically a plastic envelope or a glass capsule contains two separate compartments with one compartment containing a flowable plastic resin, and the other compartment containing a flowable plastic catalyst, for hardening the other plastic material upon contact. Inasmuch as such materials are well known in the art for maintaining the installed tension on the roof bolts, further description thereof is not necessary for one skilled in the art to practice this invention.

The container 200 is suitably inserted into the line 183 and, is thrust, typically via compressed air suitably supplied to the line 183, through the line 183, the connector 182 and the bores 186 and 168, into the upper end of the drilled hole 198 in the roof strata. The container 200 is of a size relative to the line 183, the connector 182, the bore 186, the bore 168 and the drilled hole 198, through which the container sequentially passes, to act as a movable piston while traveling therethrough under the force of the driving compressed air. Since the bore 184 remains open to the bore 160 during insertion of the capsule 200, any entrapped air ahead of the container 200, prior to the instant when the container 200 enters the bore 168, is exhausted through the bore 184 to eliminate any back pressure on the container 200 which could, otherwise, tend to inhibit the travel of the container 200. As the container 200 travels through the bore 168 and the drilled hole 198 any excess air ahead of the container 200 is able to leak or escape past the container 200 and into the bore 184. The container 200 is a flexible member and when located in the upper end of the hole 198 the container remains there upon release of the pressure of the compressed air from the lowermost end of container 200. In particular, since the drill centralizer assembly 112 is not moved after the drilling of the hole 198, the container 200 will always be driven upwardly into the hole 198. Once the container 200 is located in the upper end of the drilled hole 198 the compressed air supply is discontinued and, due to the forcing of container 200, the container 200 remains in the upper end of hole 198. At this time, the plate 100 and the drill centralizer assembly 112 are retracted from the roof line 192, via actuation of the cylinder assembly 98 in a reverse direction to that previously described, to permit the spinner motor 114 and the structure carried therewith to be vertically aligned with the drilled hole 198 via actuation of cylinder assembly 80 to move the table 70.

Prior to the drilling operation, such as before the vehicle is moved into the drilling and bolting position a roof bolt 126 having a bolt plate 156 carried thereby may be manually inserted into alignment with the spinner motor 114. The bolt should be loaded into the driving mechanism prior to drilling because, inter alia, debris from drilling could clog the seat for the bolt in the driving mechanism. For such manual insertion the bolt plate centralizer assembly 140 typically has the open slot 147 facing inwardly towards the vehicle 2. A roof bolt 126 with a bolt plate 156 loosely carried by a bolt 126 is manually swung through a vertical arc so that the bolt 126 passes through the slot 147 and enters the opening 148 with the head 124 of the bolt 126 being at the lower end of the bolt 126. Depending on various factors the bolt head is dropped into the tubular guide 128 for subsequent engagement by the head socket 122. In the process of inserting the bolt 126 into the bolt plate centralizer 140, the bolt plate 156 passes through the lower wall segments 149 and 150 and hits the higher wall segments 151, 152. In a preferred embodiment upon continued lateral movement the bolt plate impacts both higher wall segments 151, 152 consecutively, although the impact seems to occur substantially simultaneously. The bolt plate 156 is properly aligned for reception into the chamber 148 by such consecutive wall impact and the bolt plate 156 then drops within the chamber defined by all of the wall segments 149 through 152 and is loosely and captively retained within the chamber of opening 148 defined by the wall segments 149 through 152. It should be noted that in manual loading of the bolts 126 it may be necessary to jiggle the plate 156 somewhat to assure retention within the wall segments 149 to 152.

Figure 14:
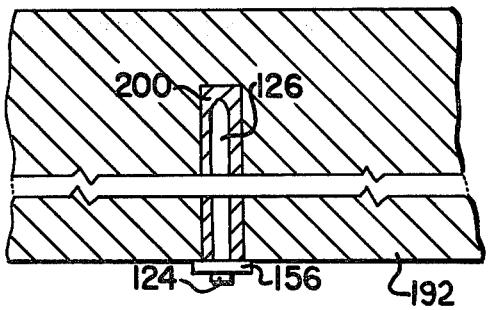

With the bolt 126 and the plate 156 so retained in the guide 128 and the centralizer 140, respectively, the cylinder assembly 80 is actuated to extend with the table 70 moving outwardly over the upper end and lower slide members 60, 62. In normal operation the stroke of the cylinder assembly 80 is set so that upon a given or set extension, perhaps upon full extension, the bolt 126 is perfectly, vertically aligned with the drilled hole 198. With the bolt 126 so aligned the cylinder assembly 96 is extended so that the bolt 126 is moved upwardly into the lower portion of the hole 198. It will be appreciated that contact between the bolt and roof acts as a secondary stinger. The bolt is advanced, preferably by simultaneous thrust and rotation, and there is some compression in the spring 136 prior to such thrust into the drilled hole. The compression force should not exceed about one half of the primary stinging force. Thereafter the spinner motor 114 is actuated to rotate the block 120 so that the head 124 of the bolt 126 drops into the drive socket 122. Rotation of the spinner motor 114 is maintained and the drive device is substantially simultaneously actuated to drive the bolt 126 upwardly into the drilled hole 198. During such upward movement of the bolt 126 the casing of the container 200 is pierced such that the flowable plastic catalyst material mixes with the plastic resin and the mixture flows downwardly to fill the void area in the drilled hole 198 about the bolt 126. At the same time a plate 156 which has been seated in the chamber 148 in the centralizer, 140 is picked up by the tapered edge of the tubular guide 128 and the plate 156 is driven against the mine roof. Continued movement causes the biased guide 128 to force the plate against the roof, and as the spring 136 is compressed the bolt 126 is driven through the guide 128 and into contact with the plate 156 maintaining the plate against the roof. The bolt 126 and the plate 156 are held in such final position, as shown in FIG. 14 until such time as the hardening plastic mixture from casing 200 is sufficiently firm to retain the bolt 126 in position, typically less than one minute. With the bolt 126 so retained, the cylinder assembly 96 is retracted to retract the bolt plate centralizer assembly 140 from the roof line 192 and thereafter the spinner drive device is actuated to move the spinner motor 114 to the lower end of the traveling plate 104. At this time the framework 76 is repositioned inwardly by retracting the cylinder 80 and another bolt 126 and plate 156 is installed.

Preferably the roof bolt of this invention is provided with magazine assembly 154 to provide for the holding and the automatic supplying of a plurality of roof bolts 126 and plates 156. The remote operated magazine assembly eliminates swinging arms, springs and other devices that were required to seat a bolt by prior art methods. The remote operation is considered so successful because of the structure of the bolt plate centralizer 140 described in detail above. The magazine assembly 154 comprises a vertically extending elongated shaft 202 which is suitably rigidly secured to a plate 204 which plate 204 has a hub 206 extending therefrom which rotatably encompasses the shaft 202 for circular movement. The hub 206 has suitable means, such as a set screw or screws to rigidly secure the hub 206, and the assembly 154 carried thereby, with respect to the shaft 202. A formed elongated housing 208 encompasses the shaft 202 and is rotatably supported thereby for indexed rotational movement. The housing 208 has a formed lower plate 210 upwardly adjacent the lower end of the shaft 202 and a formed upper plate 212 downwardly adjacent the upper end of the shaft 202. A plurality of supports 214 are suitably secured to the plates 210, 212, such as by being welded thereto. The supports 214 are spaced circumferentially about the central rotative axis of the shaft 202 and have upper and lower roof bolt retaining clips 216 suitably rigidly secured thereto. The clips 216 extend transversely outwardly of the supports 214 inwardly adjacent the ends of the supports 214, respectively. Each clip 216 is provided with a pair of resilient fingers which are outwardly open with respect to the central axis of the shaft 202 for frictionally receiving a portion of the vertically extending portion of a roof bolt 126 to retain the roof bolts 126 in a vertical position. The clips 216 and the supports 214 are located so that a bolt 126 is supported outwardly, with respect to the axis of the shaft 202 by each support 214 with the central axis of each bolt 126 being generally in a common circle with respect to the central axis of the shaft 202 such that the heads 124 thereof can be encompassed by a coupling 128. In inserting a bolt 126 into the clips 216 in front of the supports 214, respectively, the bolt 126 is forced between the resilient fingers of the upper and lower clips 216 and then pulled vertically, either upwardly or downwardly as required, so that the bolt heads 124 are vertically properly positioned. Thereafter a central aperture of a bolt plate 156 is loosely placed over each bolt 126 with the inner portion thereof, with respect to the central axis of the shaft 202 being supported by the upper surface of the upper plate 212. The bolt 126 with the bolt plate 156 attached thereto faces the opening 147 in the bolt plate centralizer 140. As the centalizer 140 is moved in the direction of the bolt 126, the bolt plate 156 just clears the lower wall segments 149 and 150 and continues movement until the plate 156 hits the higher wall segments 151 and 152. The impact causes the bolt 126 and attached plate 156 to be properly aligned and the plate 156 seats into the chamber 148 for subsequent deliver of the bolt into the drilled hole 198. After the plate 156 is seated in the chamber 148, the tubular guide 128 is raised to capture the bolt head 124. When the bolt and plate are so positioned the bolt plate centralizer 140 is moved away from the magazine 154. Such movement releases the bolt 126 from the friction engagement with the resilient fingers. Note that in a preferred embodiment the bolt plate centralizer 140 is moved toward the magazine to receive a bolt 126 when the drill rod 110 and bit are moved into the drilling position. The magazine 154 is rotated to align the next bolt 126 and plate 156 for remote controlled delivery to the bolt plate centralizer 140 before the next hole 198 is ready to be drilled into the mine roof.

It will be appreciated that the device of the present invention is capable of significant reach and significant flexibility inside an underground mine. In particular, this device is readily able to automatically drill holes and inject bolts into otherwise difficult to reach areas of the roof such as corner areas. Although the above discussion is particularly directed to drilling holes and injecting bolts substantially along a vertical plane, typically in rows having four or five foot centers between bolts, with respect to a substantially horizontal mine roof, it should be understood that the apparatus is capable of drilling holes and inserting bolts at various angles. It should also be appreciated that the apparatus of this invention reduces, significantly, the cycle time required to install a roof bolt and to move the machine to the next roof bolting location.

What is believed to be the best mode of this invention has been described above. It will be apparent to those skilled in the art that numerous variations of the illustrated and described details may be made without departing from this invention.

What is claimed is:

1. An underground mine roof bolting apparatus of the type having a frame capable of moving within said underground mine, a boom extending from said frame, said boom capable of horizontal and vertical and lateral movement and having a housing provided at the outer end thereof, said housing comprising:

an upwardly extending stinger capable of laterally anchoring said housing with respect to said roof;

a drill centralizer mounted on said housing and capable of moving with respect to said housing into engagement with said roof;

a drill rod having a drill bit attached to the end thereof, said drill rod capable of moving with respect to said housing and said drill centralizer through a central bore of said drill centralizer into engagement with said roof for drilling a hole therein;

said centralizer having a first passageway in communication with said central bore thereof, said passageway located intermediate said drill bit and said roof when said drill rod is in a retracted position;

means for delivering a container of roof bolt anchoring media throught said passageway and through said central bore into said hole drilled by said drill rod after said drill rod has been moved to said retracted position and while said centralizer is still in engagement with said roof;

means for retracting said drill rod and drill centralizer from engagement with said roof such that said drill rod and drill centralizer are moved out of alignment with said drill hole and substantially simultaneously moving a roof bolt into alignment with said drill hole; and means for driving said roof bolt into said drill hole thereby setting the anchoring media around said roof bolt.

2. An apparatus as set forth in claim 1 wherein said frame is mounted on wheels at least one of which is powered by a diesel engine.

3. An apparatus as set forth in claim 1 wherein actuatable valves for the drill, the indexing means and the anchoring media delivering means are provided at the frame.

4. An apparatus as set forth in claim 1 wherein the housing comprises a generally rectangular framework having an inner cross member and an outer cross member joined together in spaced relationship through upper and lower slide members, said framework having an enlarged central portion connected to the boom through a roll joint, said framework also having a table slidably mounted thereon.

5. An apparatus as set forth in claim 4 wherein the table is extensible and retractable by the action of a hydraulic cylinder assembly having one end thereof attached to the table.

6. An apparatus as set forth in claim 4 wherein the drilling mechanism and the roof bolt driving means are each moveably mounted on separate plates on the slidable table with the longitudinal axis of the drilling mechanism substantially parallel to the longitudinal axis of the roof bolt driving means.

7. An apparatus as set forth in claim 6 wherein the first plate upon which the drilling mechanism is mounted is capable of independent expansion and retraction by the action of a hydraulic cylinder assembly mounted on the table and connected to said first plate.

8. An apparatus as set forth in claim 6 wherein the second plate upon which the roof bolt driving means is mounted is capable of independent expansion and retraction by the action of a hydraulic cylinder assembly mounted on the table and connected to said second plate.

9. An apparatus as set forth in claim 1 wherein said roof bolt driving means further includes a generally cup shaped bolt head drive block adapted to receive the head of a roof bolt.

10. An apparatus as set forth in claim 1 wherein the wall segments adjacent the opening of the bolt plate centralizer have a length less than that of the wall segments opposite the opening whereby a bolt plate attached to a roof bolt moving laterally into said opening passes over the lower wall segments and hits the higher wall segments upon continued movement.

11. An apparatus as set forth in claim 10 wherein the opening in the bolt plate centralizer is generally circular.

12. An apparatus as set forth in claim 10 wherein the chamber within the wall segments of the bolt plate centralizer is generally rectangular.

13. An apparatus as set forth in claim 12 wherein four wall segments form said chamber, with the two wall segments adjacent the opening having a lesser extent from the base plate of the bolt plate centralizer than the extent of the two wall segments opposite the opening.

14. An apparatus as set forth in claim 13 wherein the two higher wall segments form a right angle at a junction therebetween and the opening is substantially opposite said junction such that a bolt plate passing laterally over the lower wall segments hits both higher wall segments consecutively upon continued lateral movement.

15. An apparatus as set forth in claim 1 wherein the means for driving the roof bolt comprises a spinner motor having an output shaft extending therefrom and a bolt head driving block disposed at the outer end of said shaft.

16. An apparatus as set forth in claim 15 wherein said driving block extends coaxially away from said shaft.

17. An apparatus as set forth in claim 15 wherein said driving block includes means for receiving the head of a roof bolt therein.

18. An apparatus as set forth in claim 17 wherein said bolt head receiving means comprises a recess in the driving block having a cross sectional configuration to receive the head of the roof bolt therein.

19. An apparatus as set forth in claim 16 wherein a tubular guide is provided about the roof bolt driving block.

20. An apparatus as set forth in claim 19 wherein an outer peripheral portion of the tubular guide is tapered outwardly.

21. An apparatus as set forth in claim 19 wherein the tubular guide is moveable away from the driving block.

22. An apparatus as set forth in claim 18 wherein the driving block is biased in the direction of the spinner motor.

23. An apparatus as set forth in claim 22 wherein said bias is provided by a spring about the output shaft of the spinner motor one end of which abuts a retaining device on the output shaft adjacent the spinner motor, and the other end of which abuts the tubular guide.

24. A bolt plate centralizer for a roof bolting apparatus comprising:

a generally planar base having an opening therein for accommodating a portion of a transversely disposed roof bolt therein, said base substantially surrounded by a plurality of wall segments extending outwardly and upwardly of the general plane of the base, said wall segments and said base forming a chamber thereamong for accommodating a bolt plate therein, said bolt plate having an aperture therein through which the bolt is disposed such that said plate is transversely disposed loosely at one end of the roof bolt, with the wall segments adjacent the opening having an extent less than that of the wall segments opposite the opening such that as the roof bolt is moved laterally into the opening the bolt plate loosely disposed thereon passes over the lower wall segments and the bolt plate hits the higher wall segments upon continued movement.

25. A bolt plate centralizer as set forth in claim 24 wherein said opening is generally circular.

26. A bolt plate centralizer as set forth in claim 24 wherein said chamber is generally rectangular.

27. A bolt plate centralizer as set forth in claim 26 wherein there are four wall segments, with the two wall segments adjacent the opening of a lesser extent than that of the two wall segments opposite the opening.

28. A bolt plate centralizer as set forth in claim 27 wherein the two higher wall segments form a substantially right angle at a junction therebetween and the opening is substantially opposite said junction such that a bolt plate passing laterally over the lower wall segments hits both higher wall segments consecutively upon continued movement to align the bolt plate within the chamber.

29. A method of bolting the roof of an underground mine, comprising the steps of:

stinging a housing against the roof of the underground mine, moving a peripheral end of a drill centralizer into communication with the roof, moving a drill rod with a drill bit attached to the end thereof, through a central bore of the drill centralizer and into the roof, retracting the drill rod such that the drill bit is at a position rearward of a passageway communicating with the central bore of the centralizer, without retracting the drill centralizer from communication with the roof, delivering a container of roof bolt anchoring media through the passageway and through the centralizer and into the drilled hole, retracting the drill centralizer and moving the housing such that the drill rod is moved out of alignment with the drilled hole as a roof bolt is moved substantially simultaneously into alignment with the drilled hole, said roof bolt having the bolt head in a sleeve and the end of the bolt opposite the bolt head loosely disposed through an aperture in a bolt plate, said bolt and plate provided in a bolt plate centralizer by moving the loosely disposed plate toward an opening in a generally planar bar of a bolt plate centralizer having wall segments extending outwardly and upwardly of the base, such that the plate passes over the wall segments adjacent the opening and impacts consecutively against the wall segments opposite the opening, driving the roof bolt into the drilled hole, and setting the anchoring media around the roof bolt.

30. A method as set forth in claim 29 wherein the force exerted by the drilling step is less than one-half of the force exerted by the stinging step.

31. A method as set forth in claim 29 wherein the force exerted by the bolt driving step is less than one-half of the force exerted by the stinging step.

32. A method as set forth in claim 29 wherein all steps are controlled by actuators provided at a location remote from the location where the steps are performed.

33. A method as set forth in claim 29 wherein a portion of the drilling debris is removed during and after the drilling step by drawing said debris through a second passageway in communication with the central bore of the drill centralizer.

34. A method as set forth in claim 29 including the preliminary step of positioning a vehicle, supporting said housing, for said drilling step.

35. A method as set forth in claim 29 wherein the housing is stung to the roof of an underground mine by moving an outwardly extending arm on said housing against the roof of an underground mine with a force of at least about 1,000 pounds per square inch.

36. A method as set forth in claim 35 wherein said arm is is moved against the roof with a force of from about 2,000 to 4,000 pounds per square inch.

37. A method as set forth in claim 29 wherein a head of the roof bolt is disposed into a receiving block as the roof bolt is positioned for alignment.

38. A method as set forth in claim 37 wherein the roof bolt is driven into the drilled hole by simultaneous spinning and thrusting of the receiving block having the head of the bolt received therein.

39. A method for inserting a roof bolt having a bolt head at one end and a bolt plate loosely carried at the other end of the roof bolt by inserting the bolt through an aperture in the plate, into a roof bolt inserting device comprising the steps of:

inserting the bolt head into a receiving block, substantially laterally moving the bolt plate carried at the other end of the roof bolt toward an opening in a generally planar base of a bolt plate centralizer, passing the plate over first outwardly extending wall portions of the bolt plate centralizer, continuing lateral movement of the bolt plate and impacting the bolt plate against second outwardly extending wall portions of the bolt plate centralizer, and dropping the bolt plate onto the base and into a receiving chamber defined among the first and second outwardly extending wall portions of the bolt plate centralizer.

40. A method as set forth in claim 39 wherein the bolt insertion is performed manually.

41. A method as set forth in claim 39 wherein the bolt is mechanically inserted from an adjacent magazine housing a plurality of bolts.

* * * * *